United States Patent [19]

Rose

[11] Patent Number: 4,997,316

[45] Date of Patent: Mar. 5, 1991

[54] METHOD AND APPARATUS FOR CONSTRUCTING A RETAINING WALL

[76] Inventor: George P. Rose, 3321 S. 122nd St., Omaha, Nebr. 68144

[21] Appl. No.: 412,661

[22] Filed: Sep. 26, 1989

[51] Int. Cl.[5] ..... E02D 29/02

[52] U.S. Cl. ..... 405/284; 405/273

[58] Field of Search ..... 405/284, 286, 273; 52/102, 233

[56] References Cited

U.S. PATENT DOCUMENTS

| | | | |
|---|---|---|---|
| Re. 16,689 | 7/1927 | Ford | 405/273 |
| 1,688,305 | 10/1928 | Fitzgerald | 405/273 |
| 1,819,026 | 8/1931 | Hobson | 405/273 |
| 1,907,053 | 5/1933 | Flath | 405/273 |
| 4,463,532 | 8/1984 | Faw | 52/233 |
| 4,815,897 | 3/1989 | Risi | 405/273 |
| 4,834,585 | 5/1989 | Hasenwinkle | 405/284 |

*Primary Examiner*—John E. Murtagh

*Attorney, Agent, or Firm*—Zarley, McKee, Thomte, Voorhees & Sease

[57] ABSTRACT

A method and apparatus for constructing a retaining wall includes a first course having a pair of elongated beams positioned generally end-to-end on the ground, a deadman positioned between the adjacent ends of the beams and extending rearwardly therefrom, and a spacer block positioned on the ground rearwardly of an intermediate portion of one of the elongated beams. A second course is fastened on top of the first course and includes a third beam having each end fastened to the two elongated beams of the first course, and a deadman having its forward end fastened to one beam and the rearward end fastened to the spacer block so as to support the deadman during back filling of dirt against the retaining wall. Preferably, the spacer block, deadmen and beams all have the same cross-sectional width, and each component has a longitudinal length equal to a multiple of the cross-sectional width, so as to form a modular building component system. Each component has at least one countersunk anchor hole which will receive either a ground anchor or a screw-type fastener. The ground anchor is specially designed with wide, flat threads so as to engage the soil and prevent movement of the first course on the ground. Pilot holes are formed in the various components to receive the threaded portion of the wood screws to fasten the upper courses to lower courses.

3 Claims, 2 Drawing Sheets

METHOD AND APPARATUS FOR CONSTRUCTING A RETAINING WALL

TECHNICAL FIELD

The present invention is directed towards a method and apparatus for constructing a retaining wall and more specifically to a method and apparatus for constructing a retaining wall which does not require back filling.

BACKGROUND OF THE INVENTION

Retaining walls are constructed for a wide variety of purposes. These purposes include stabilizing the soil, providing a decorative structure for use in landscaping work and controlling the erosion and other damaging effects caused by water. One popular method type of retaining wall is formed of large wooden planks such as railroad ties or the like. The wall is formed by laying the tie on the ground and stacking other ties thereon to form the wall. As the ties are stacked upon one another, they are usually secured to each other using large spikes or nails.

A series of short ties are positioned transversely to the long beams, and spaced between the large beams, so as to extend rearwardly from the wall into the ground. However, these short ties, known as "deadmen", are effective only insofar as the soil therebeneath, which functions as a footing, is fully compacted and stable. To compact the soil requires extensive time and effort, as well as special skill, and thereby increases the expense of constructing a wall. If the soil is improperly compacted, the structural stability of the wall is greatly reduced and increases the risk that the wall will bulge, sag and/or collapse.

It is therefore a principal object of the present invention is to provide an improved method and apparatus for constructing a retaining wall.

Another object of the present invention is to provide a modularized retaining wall system which does not require the ground to be compacted adjacent the wall.

A further object of the present invention is to provide a method and apparatus for constructing a retaining wall which is less labor intensive to construct than conventional retaining walls.

Still another object of the present invention is to provide a method and apparatus for constructing a retaining wall which is refined in appearance, durable and easy to construct.

These and other objects will be apparent to those skilled in the art.

SUMMARY OF THE INVENTION

The method and apparatus for constructing a retaining wall in the present invention includes a first course having a pair of elongated beams positioned generally end-to-end on the ground, a deadman positioned between the adjacent ends of the beams and extending rearwardly therefrom, and a spacer block positioned on the ground rearwardly of an intermediate portion of one of the elongated beams. A second course is fastened on top of the first course and includes a third beam having each end fastened to the two elongated beams of the first course, and a deadman having its forward end fastened to one beam and the rearward end fastened to the spacer block so as to support the deadman during back filling of dirt against the retaining wall. Preferably, the spacer block, deadmen and beams all have the same cross-sectional width, and each component has a longitudinal length equal to a multiple of the cross-sectional width, so as to form a modular building component system. Each component has at least one countersunk anchor hole which will receive either a ground anchor or a screw-type fastener. The ground anchor is specially designed with wide, flat threads so as to engage the soil and prevent movement of the first course on the ground. Pilot holes are formed in the various components to receive the threaded portion of the wood screws to fasten the upper courses to lower courses.

BRIEF DESCRIPTION OF THE PREFERRED EMBODIMENT

Figure 1:
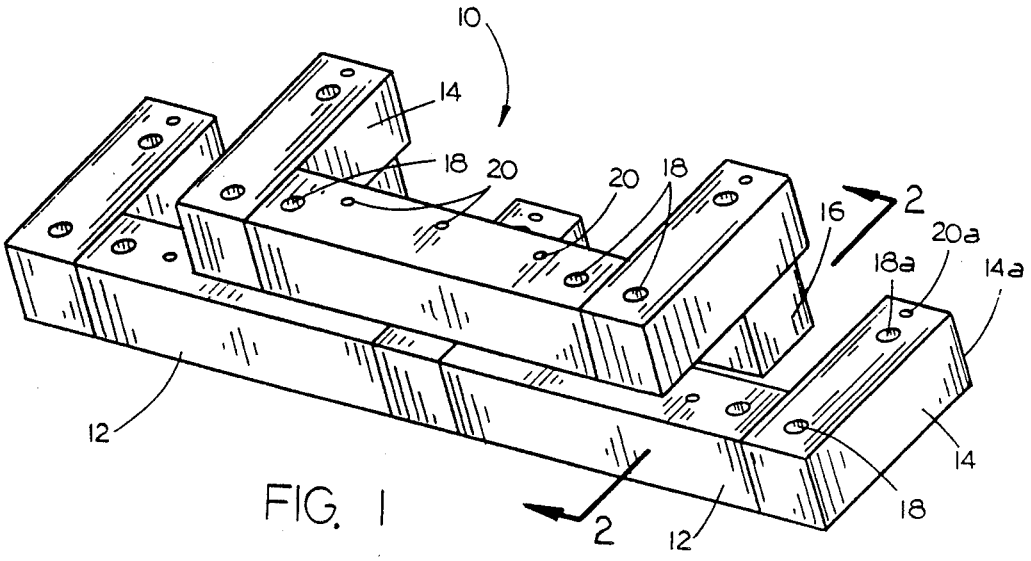
FIG. 1 is a pictorial view of a retaining wall formed by the method and apparatus of this invention.

Referring now to the drawings, in which identical or corresponding parts are identified with the same reference numeral, a wall formed by the method and apparatus of the present invention is identified generally at 10 and is composed of three basic building components: an elongated beam 12, a transversely oriented deadman 14, and a spacer block 16. In order to facilitate ease of construction, all of the components of the retaining wall 10 are modular, so as to have identical cross sectional widths and heights and a length based upon a multiple of the cross sectional width. In the preferred embodiment, beams 12 have a longitudinal length equal to 5 times its cross sectional width, the deadman 14 has a length 3 times its cross section width, and the spacer block 16 has a length equal to its cross sectional width.

Figure 2:
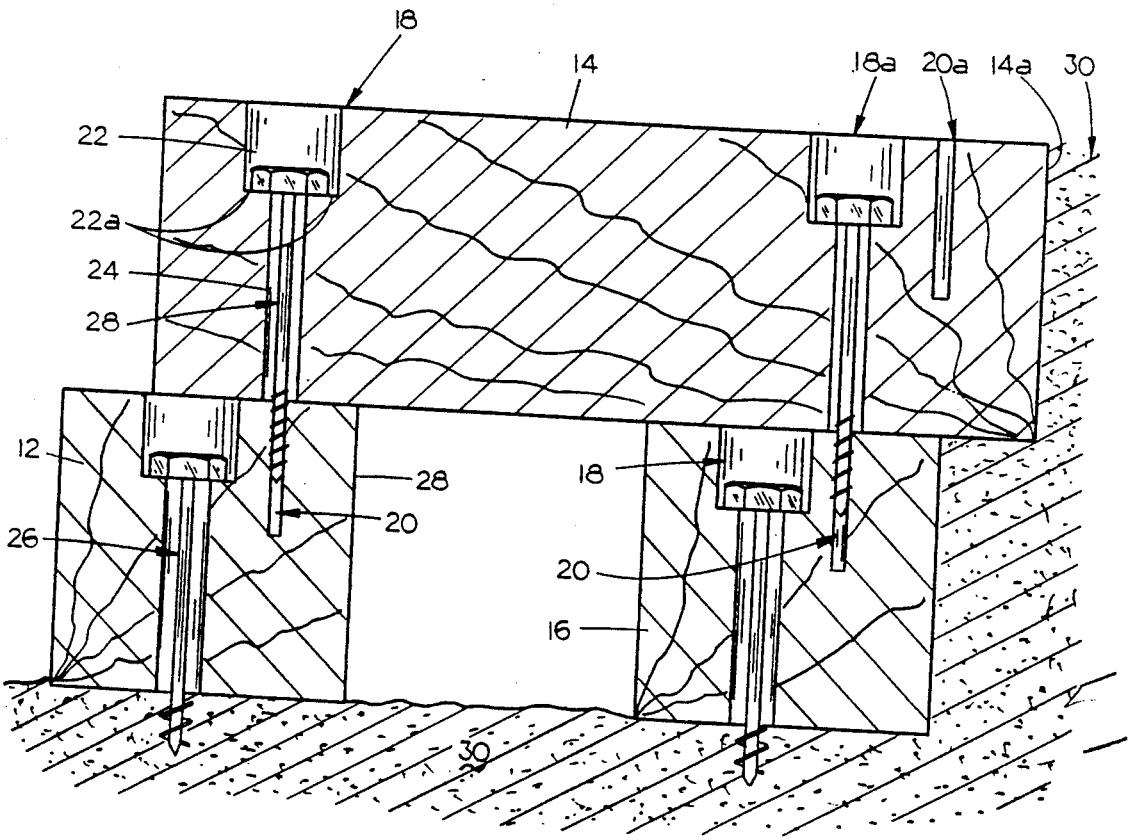
FIG. 2 is a sectional view taken at lines 2—2 in FIG. 1.

Each beam 12, deadman 14 and spacer block 16 has two types of holes therethrough, namely, an anchor hole 18 and a pilot hole 20. As shown in FIG. 2, each anchor hole 18 has an upper countersunk portion 22 and a lower shaft portion 24 with a smaller diameter than the countersunk portion 22. Anchor holes 18 will thereby receive either a ground anchor 26 or a lag screw 28 therein, with the head of the anchor or screw resting on the shoulders **22*a* of the countersunk portion 22 of anchor hole 18**.

Each pilot hole 20 has a small diameter so as to receive the threaded end of a lag screw 28 therein. Pilot holes 20 extend only approximately midway through the beam 12, deadman 14 or spacer 16, and are designed to guide the lag screw 28 while preventing cracking or splitting of the building component.

Figure 3:
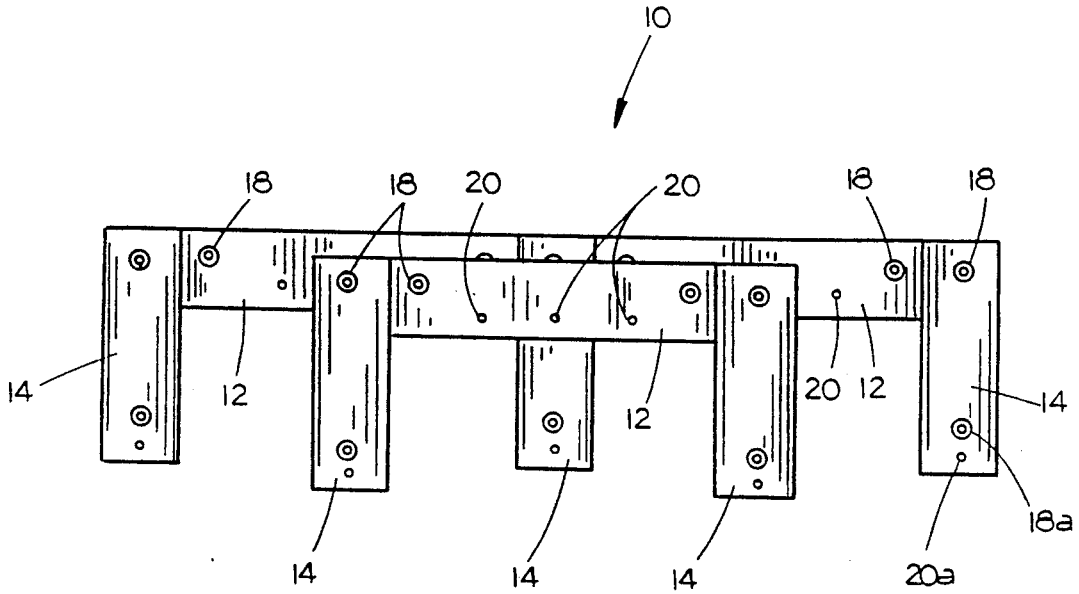
FIG. 3 is a top view of the retaining wall of FIG. 1.

Referring now specifically to FIGS. 1-3, each beam 12 has an anchor hole 18 formed at each end thereof, and three pilot holes 20 uniformly spaced therebetween. Anchor holes 18 are generally centered in the cross sectional width of the beam, while pilot holes 20 are formed along a longitudinal axis generally centered between the rearward face 28 of the beam and a longitudinal line passing through the center of anchor holes 18.

This set back of pilot holes 20 will cause a subsequent course of beams and building components to be slightly set back, rather than forming a perfectly vertical wall.

This stepped formation increases the stability and strength of the retaining wall by providing reinforcement against lateral forces applied by back filled dirt or ground adjacent the upper courses of the wall 10. Obviously, as the retaining wall is built to greater heights, the force of the soil 30 in a lateral direction against the wall will increase. A perfectly vertical wall is much less stable against such transverse force than is a stepped wall.

Each deadman 14 has a pair of uniformly spaced apart anchor holes 18 therein, and is designed to extend rearwardly between pairs of end-to-end beams 12. Thus, deadmen 14 will extend into the dirt or ground which is being retained by the wall. A pilot hole 20*a* is centered between the rearward end 14*a* of deadman 14 and the rearward-most anchor hole 18*a*.

Conventionally, retaining walls are built utilizing beams intermixed with deadmen, with each subsequent course being staggered. The present invention follows this same pattern, but steps each subsequent course rearwardly, as shown in the drawings. The invention also augments this method and procedure by utilizing spacer blocks between vertically spaced-apart deadmen. As noted above, one of the problems with the current method for constructing retaining walls is that the back fill of dirt around the deadmen against the retaining wall requires special expertise to compact the soil. Even after the soil has been compacted, it can be seen that any natural settling or movement of the ground around the deadmen will cause the projecting ends of the deadmen to move. This movement causes a weakening in the wall, such that bulges, sags or breaks may occur in the wall. The applicant prevents this by utilizing spacer blocks 16 between vertically spaced deadmen 14. Thus, each spacer block 16 has an anchor hole 18 therein, and a pilot hole 20 adjacent to the anchor hole. In this way, a lag screw 28 from a deadman will register with the pilot hole in the spacer block below the deadman, and the anchor hole in the spacer block will register with the pilot hole 20*a* of a deadman which may be positioned below the spacer block 16.

Another drawback to current methods of constructing retaining walls is in the method for securing the components to each other and to the ground. In most cases, the wall is not secured to the ground, and relies on the weight of the wall to maintain the position with respect to the ground. In some instances, a long nail-type spike may be utilized to secure the lowest course of the wall to the ground. However, in conventional residential uses, the building components do not have a large cross section, and therefore, will not accept a large diameter spike. While narrow diameter spikes may be utilized, the friction between the spike and the ground is not always sufficient to prevent movement of the wall. For this reason, an improved ground anchor 26 has been designed for use with the invention.

Figure 5:
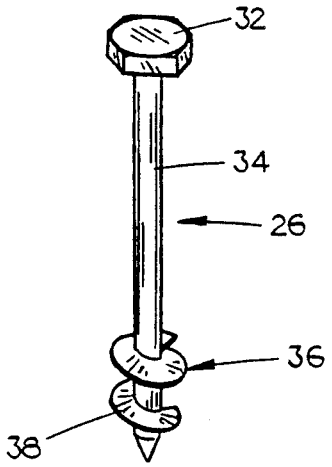
FIG. 5 is an enlarged perspective view of a wood screw with the present invention.

Referring to FIG. 5, the ground anchor 26 utilized with the present invention includes hexagonal head 32 and a shank 34 depending therefrom. A special thread 36 is utilized which has very wide and flat teeth 38 which are widely spaced so as to effectively grip soil. The use of a very small number of widely spaced and large surface area teeth 38 effectively holds ground anchor 26 in the soil 30.

Figure 4:
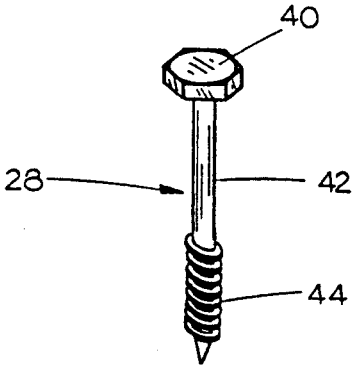
FIG. 4 is an enlarged perspective view of a ground anchor used with the present invention.

Lag screw 28 is also specially designed for use with the building components of the present invention. As shown in FIG. 4, lag screw 28 has a large hexagonal 40 and a long unthreaded shank 42 depending therefrom. A short section of threads 44 are utilized at the lower end of shank 42 which will grip wood in a conventional fashion. To construct a retaining wall, the first course of the wall is laid out utilizing a series of beams 12 laid end to end, with deadmen 14 positioned transversely between pairs of beams so as to extend rearwardly towards the ground to be retained by the wall. The first course is then fastened to the ground utilizing a plurality of ground anchors 26 journaled anchor holes 18 and the beams and deadmen. The second course of the wall is preferably staggered with respect to the first course, and spacer blocks 16 are then positioned rearwardly and spaced from beams 12 directly under the location of the rearward end of a subsequent deadman 14. In the configuration shown in FIGS. 1–3, spacer blocks 16 are located rearwardly of the center of the three pilot holes 20 in beams 12.

The second course is then laid atop the first with beams 12 staggered and set back with respect to the first course. Lag screws 28 are journaled through anchor holes 18 in beam 12, and will register with a pilot hole in beams 12 of the first course, as shown in FIG. 2. Additional lag screws 28 are then journaled through anchor holes 18 and 18*a* and deadmen 14 so as to fasten the deadmen to the beams 12 and spacer blocks 16. Additional courses may be added in a similar fashion.

Whereas the invention has been shown and described in connection with the preferred embodiment thereof, it will be understood that many modifications, substitutions and additions may be made which are within the intended broad scope of the appended claims. For example, ground anchors 26 and lag screws 28 are described having hexagonal heads. Obviously slots may be cut in the head for use with screw drivers to secure the retaining wall components. Likewise, the modular dimensions utilized in the above description may be varied utilizing multiples of the cross sectional width of the members.

Therefore, there has been shown and described an improved method and apparatus for constructing a retaining wall which accomplishes at least all of the above stated objects.

I claim:

1. A method of constructing a retaining wall, comprising the steps of:

providing a plurality of modular building components, including:

at least first, second and third elongated beams having a forward face, rearward face, upper and lower sides and opposing ends;

at least first and second deadmen having forward ends, rearward ends and upper and lower sides;

at least one spacer block;

a plurality of ground anchor means; and a plurality of fastener means;

fastening a first course of building components to the ground using said ground anchor means, including the steps of:

fastening said first and second beams and said first deadman to the ground, said first deadman positioned on the ground between adjacent ends of said first and second beams, and projecting rearwardly therefrom;

fastening said spacer block to the ground spaced rearwardly from an intermediate portion of said first beam;

fastening a second course of modular building components to the upper side of the first course of modular building components utilizing said plurality of fastener means, comprising the steps of:

fastening one end of said third beam to the upper side of said first beam;

fastening the opposite end of said third beam to the upper side of said second beam;

fastening the forward end of said second deadman to the upper side of said first beam, adjacent the end of said third beam; and fastening the rearward end of said second deadman to the upper side of said spacer block; and back filling soil against the constructed retaining wall.

2. A retaining wall, comprising:

fastener means for selectively fastening an upper second course to the top of a lower first course;

a first course, including:

at least two elongated beams positioned generally end to end on the ground, each beam having a forward face, rearward face, upper and lower sides and opposing ends;

a first deadman positioned on the ground between the adjacent ends of said first and second beams and projecting rearwardly therefrom, said deadman having a forward end, a rearward end, and upper and lower sides;

a spacer block positioned on the ground spaced rearwardly from an intermediate portion of said first beam, said spacer block having upper and lower sides; and a second course including:

a third beam having one end fastened to the upper side of said first beam and a second opposite end fastened to the upper side of said second beam; and a second deadman having its forward end fastened to the upper side of said first beam, adjacent the end of said third beam, and extending rearwardly from said first beam, and having its rearward end fastened to the upper side of said spacer block to support the rearward end of said deadman during and after back filling of dirt against the retaining wall;

ground anchor means for fastening each said first and second beams, said first deadman, and said spacer block to the ground;

each said ground anchor means includes an enlarged head portion, an elongated shank depending from said head portion, and a thread portion at the lower end of said shank and spaced from said head portion, said thread portion comprising a wide, flat, tooth extending in a helix about said shank less than three revolutions, said revolutions being widely vertically spaced so as to grip ground soil.

3. A retaining wall, comprising:

fastener means for selectively fastening an upper second course to the top of a lower first course;

a first course, including:

at least two elongated beams positioned generally end to end on the ground, each beam having a forward face, rearward face, upper and lower sides and opposing ends;

a first deadman positioned on the ground between the adjacent ends of said first and second beams and projecting rearwardly therefrom, said deadman having a forward end, a rearward end, and upper and lower sides;

a spacer block positioned on the ground spaced rearwardly from an intermediate portion of said first beam, said spacer block having upper and lower sides; and a second course including:

a third beam having one end fastened to the upper side of said first beam and a second opposite end fastened to the upper side of said second beam; and a second deadman having its forward end fastened to the upper side of said first beam, adjacent the end of said third beam, and extending rearwardly from said first beam, and having its rearward end fastened to the upper side of said spacer block to support the rearward end of said deadman during and after back filling of dirt against the retaining wall;

each said spacer block, deadmen and beams having the same cross-sectional width, the cross-sectional width taken along a line cut perpendicular to the longitudinal axis of said spacer block, deadmen end beams;

each said spacer block, deadmen and beam having a longitudinal length equal to a multiple of said cross-sectional width, so as to form modular building components;

each said modular building component having at least one vertical anchor hole and at least one vertical pilot hole therein;

each anchor hole extending completely through the building component and including an upper countersunk portion and a lower shank portion, the countersunk portion extending downwardly from the upper side of the building component and having diameter greater than said shank portion of said hole;

each said pilot hole extending downwardly from the upper side of the modular building component and only partially therethrough;

each said beam member having at least two anchor holes therethrough, one located adjacent each end thereof and positioned along the longitudinal center line of the upper side of said beam;

each said beam member having at least three pilot holes therein, located along a longitudinal line spaced rearwardly from the longitudinal center line of the beam, and spaced apart;

each said deadman having at least two anchor holes therethrough, one located adjacent each end thereof and positioned along the longitudinal center line of the deadman;

each said deadman having at least one pilot hole therein located along the longitudinal center line and between said rearward anchor hole and the rearward end of the deadman;

each said spacer block having an anchor hole therethrough generally centered in the upper side;

each said spacer block having a pilot hole therein located along the longitudinal center line of the upper side between said anchor hole and said rearward side; and said anchor holes and pilot holes being located in said modular building components such that fasteners extending through anchor holes in the upper course will register with the pilot holes in the lower course to cause the upper course to be stepped back with respect to the lower course.

* * * * *